US008138998B2

(12) United States Patent
Mas et al.

(10) Patent No.: US 8,138,998 B2
(45) Date of Patent: Mar. 20, 2012

(54) CONTROL OF AN ELECTROLUMINESCENT DISPLAY

(75) Inventors: Céline Mas, Poisat (FR); Corinne Ianigro, Grenoble (FR); Hervé Pierrot, Taipei (TW)

(73) Assignee: STMicroelectronics S.A., Montrouge (FR)

( * ) Notice: Subject to any disclaimer, the term of this patent is extended or adjusted under 35 U.S.C. 154(b) by 1013 days.

(21) Appl. No.: 12/101,729

(22) Filed: Apr. 11, 2008

(65) Prior Publication Data

US 2008/0309594 A1 Dec. 18, 2008

(30) Foreign Application Priority Data

Apr. 13, 2007 (FR) ..... 07 54479

(51) Int. Cl.
*G09G 3/30* (2006.01)
*G09G 3/10* (2006.01)

(52) U.S. Cl. ..... 345/76; 345/77; 345/78; 345/82; 315/169.3

(58) Field of Classification Search ..... 345/76–85, 345/90–93, 95, 98–100, 30, 46, 55, 204, 345/212; 315/169.3
See application file for complete search history.

(56) References Cited

U.S. PATENT DOCUMENTS

| | | | | |
|---|---|---|---|---|
| 6,369,515 | B1 | 4/2002 | Okuda | |
| 2003/0146784 | A1 * | 8/2003 | LeChevalier | 327/538 |
| 2003/0160744 | A1 | 8/2003 | Yoshida et al. | |
| 2003/0173904 | A1 * | 9/2003 | LeChevalier | 315/169.3 |
| 2004/0227749 | A1 * | 11/2004 | Kimura | 345/211 |
| 2005/0146281 | A1 * | 7/2005 | Ricky Ng et al. | 315/169.3 |
| 2005/0264499 | A1 * | 12/2005 | Kim et al. | 345/76 |
| 2006/0118700 | A1 | 6/2006 | Chaussy et al. | |
| 2007/0236426 | A1 * | 10/2007 | Chu et al. | 345/77 |
| 2008/0062091 | A1 * | 3/2008 | Stewart | 345/76 |

OTHER PUBLICATIONS

French Search Report from corresponding French Application No. 07/54479, filed Apr. 13, 2007, Search Report dated Sep. 14, 2007.

* cited by examiner

*Primary Examiner* — Amare Mengistu
*Assistant Examiner* — Hong Zhou
(74) *Attorney, Agent, or Firm* — Wolf, Greenfield & Sacks, P.C.

(57) ABSTRACT

A device for controlling an electroluminescent matrix display by successive selection of its lines, including a column control circuit having circuitry capable of placing, at the beginning of the selection of a line, the display column at a precharge voltage based on the operating voltage of the previous line, the column control circuit also having circuitry capable of modifying the precharge voltage according to the difference between luminance instructions of the previous line and those of the selected line.

23 Claims, 4 Drawing Sheets

CONTROL OF AN ELECTROLUMINESCENT DISPLAY

BACKGROUND OF THE INVENTION

1. Field of the Invention

The present invention generally relates to displays made in the form of a matrix of light-emitting diodes. Such a display can be used in many devices such as cell phones, devices for taking fixed or animated pictures, audio or video walkmans or even portable computers or televisions. The present invention more specifically relates to the control of such a display.

2. Discussion of the Related Art

Electroluminescent displays are organized in the form of a matrix, elementary cells or pixels being arranged at the intersections of the lines and columns. A pixel comprises at least one light-emitting diode, for example, of organic (OLED) or polymer (PLED) type. Such diodes emit light when they are forward biased beyond a given voltage threshold and conduct a current.

Displays where the illumination control is performed by successive selection of the screen lines are considered in the present application. Such a selection is performed by selecting a line, and by having the pixels conduct a current so that the diodes are activated, that is, emit light. Generally, the luminance current is injected into the pixels from the columns. For a selected line, the number of pixels to be activated as well as their location depends on the image to be displayed, the coding of which is stored in an image memory associated with the screen control circuit. The number and the location of pixels to be activated are thus likely to vary from one line to another. Further, especially for displays in levels of grey and/or for color displays, the intensity or the duration of the luminance current injection is likely to vary.

Once the selection of a line is over, the next line is selected and the selected pixels of this next line are activated.

To accelerate the emission of the selected pixels in a line, it is desirable for these pixels to be precharged. The activation of the pixels of a line thus starts with a precharge phase.

During the precharge, each screen pixel is biased to a voltage close to the voltage that it would have if it had been active. Such a precharge then enables, on activation of the pixels of the selected line, for the current injected into the pixels to be only used for the light emission and not to charge the parasitic capacitor.

The precharge is performed either by a current control, or by a voltage precharge. In a current precharge, a constant current is injected for a very short determined duration as compared with the duration of the next light-emission phase. In a voltage precharge, a voltage is applied across the diode before entering the emission phase. For clarity, a voltage precharge is considered in the following description as an example.

U.S. patent application Ser. No. 11/294991 entitled "Automatic adaptation of the precharge voltage of an electroluminescent display" and assigned to the applicant provides automatically using the operating voltage of the previous line to perform the precharge of the selected line. Such a control enables taking into account display aging effects and the effects of the variation of the luminance current from one line to another, which would translate on the displayed image as overbrightnesses or attenuations of the brightness of a same color from one line to another.

However, despite the use of such an automated adaptation of the precharge based on the operating voltage of the previous line, displays still exhibit lines or areas with an overbrightness or an attenuated brightness.

SUMMARY OF THE INVENTION

An object of the present invention is to overcome all or part of the disadvantages of electroluminescent displays.

Another object is to increase the performance of electroluminescent displays.

Another object is to improve the automatic precharge of electroluminescent displays.

To achieve all or part of these objects, as well as others, an embodiment of the present invention provides a device for controlling an electroluminescent matrix display by successive selection of its lines, comprising a column control circuit comprising means capable of placing, at the beginning of the selection of a line, the display column at a precharge voltage based on the operating voltage of the previous line, the column control circuit also comprising means capable of modifying the precharge voltage according to the difference between luminance instructions of the previous line and those of the selected line.

According to an embodiment, each column control circuit comprises means for detecting the maximum operation voltage of the column, having an output terminal capable of being controllably connected to a storage element common to all columns and an element capable of delivering, at least during a phase of precharge of the selected line, a precharge reference value based on the data stored in the storage element.

According to an embodiment, the means capable of modifying the precharge voltage comprise an offset voltage generator interposed between the storage element and the element delivering the precharge reference value.

According to an embodiment, the precharge is performed with a voltage.

According to an embodiment, the luminance instructions of the previous line and the luminance instructions of the selected line are contained in an image memory.

According to an embodiment, the means capable of modifying the precharge voltage comprise means capable of modeling the resistivity of the precharged line.

An embodiment of the present invention also provides a method of line-by-line control of a matrix display comprising light-emitting diodes arranged at the intersection of lines and columns, comprising at the beginning of the selection a line a step of line precharge based on the operating voltage of the previous line, the step of precharge of the selected line being preceded by a step of determination of the difference between the luminance conditions of the selected line and those of the previous line.

According to an embodiment, the step of determining the difference in luminance conditions between the line being selected and the previous line comprises a step of comparison of the numbers of diodes activated on each of the selected and previous lines.

According to an embodiment, the step of determining the difference in luminance conditions between the line being selected and the previous line comprises a step of comparison of the excitation times of the diodes activated on each of the selected and previous lines.

According to an embodiment, the step of determining the difference in luminance conditions between the line being selected and the previous line is totally completed during the illumination period of the previous line.

The foregoing and other objects, features, and advantages of the present invention will be discussed in detail in the following non-limiting description of specific embodiments in connection with the accompanying drawings.

DETAILED DESCRIPTION

Figure 1:
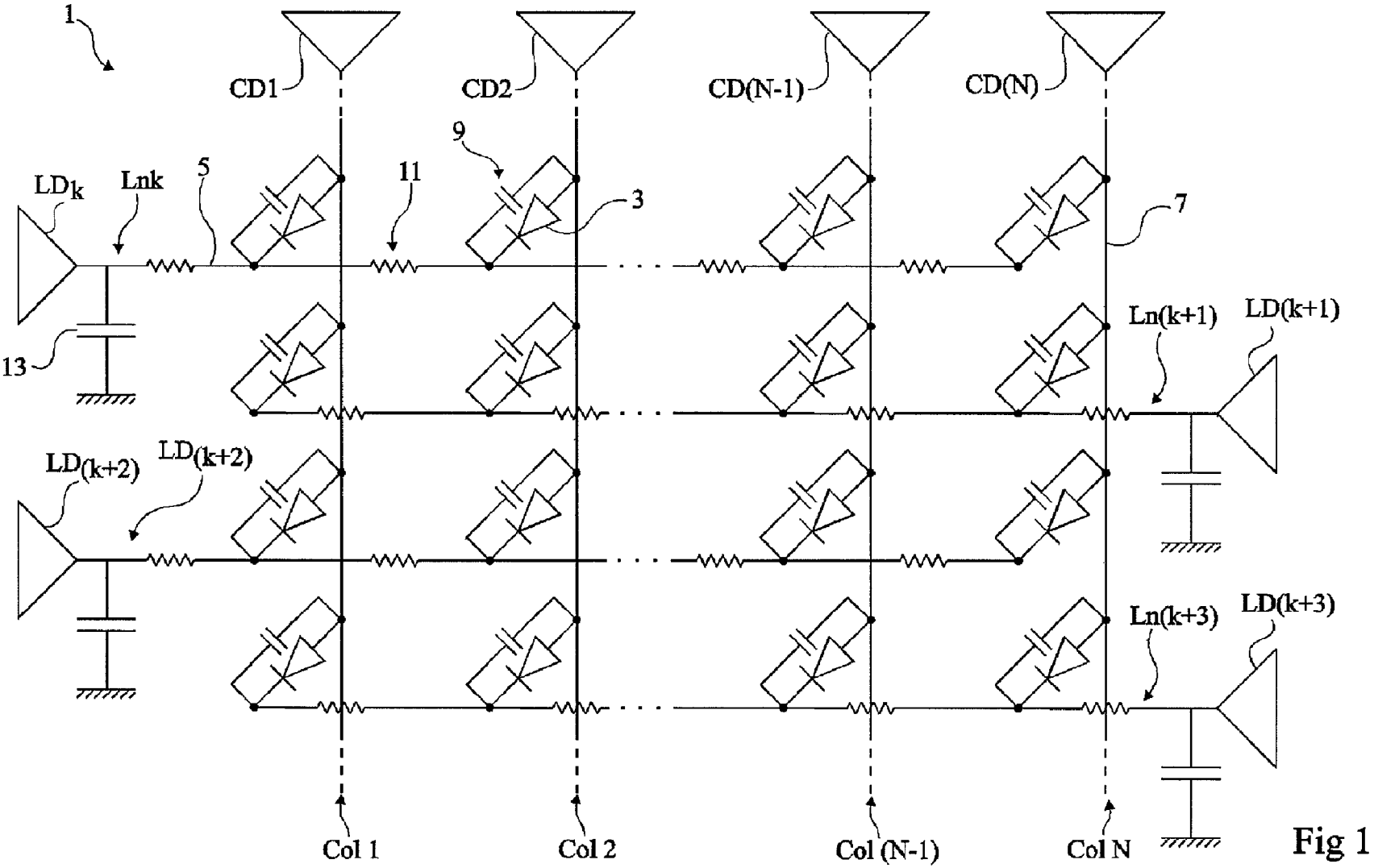
FIG. 1 illustrates, in the form of a circuit diagram, an example of an electroluminescent display.

For clarity, the same elements have been designated with the same reference numerals in the different drawings. Further, only those portions or elements of a luminescent display and/or of a control circuit associated with a luminescent display necessary to the understanding of the present application are shown and described herein.

FIG. 1 illustrates a partial equivalent electric diagram of an electroluminescent display 1. Display 1 is formed of a matrix of elementary cells or pixels arranged at the intersections of lines and columns. All columns are identical. Only the first two columns Col1 and Col2 and the last two columns Col(N−1) and ColN are shown, respectively to the left and to the right of FIG. 1. All lines have a same structure. Four successive lines Lnk, Ln(k+1), Ln(k+2), and Ln(k+3) are shown.

Each pixel comprises at least one light-emitting diode 3. Diodes 3 of display 1 are all connected in the same way between the lines and the columns. The cathodes of the diodes 3 of a same line Lnk, Ln(k+1), Ln(k+2), and Ln(k+3) are connected to a same line electrode 5. The anodes of the diodes 3 of a same columns Col1, Col2, Col(N−1), or ColN are connected to a same column electrode 7.

It should be noted that in the case of a monochrome (black and white) or grey level display, each pixel comprises a single diode 3. In the case of a color display, each pixel comprises several diodes 3, generally three, each diode being of a different color. Each column then comprises as many distinct column electrodes as there are colors, the diodes having an electrode, for example, the anode, connected to a respective one of the column electrodes. For each pixel, the other electrode of color diodes 3, here, the cathode, is connected to a same line electrode 5.

The display of an image on display 1 is performed by displaying one or two successive frames. On display of a frame, display 1 is addressed line by line by means of a line control circuit. FIG. 1 schematically illustrates output stages LDk, LD(k+1), LD(k+2), and LD(k+3) of the line control circuit associated with each of lines Lnk, Ln(k+1), Ln(k+2), and Ln(k+3). On selection of a line, the pixel activation data for the selected line are transmitted to the N columns Col1, Col2, Col(N−1), and ColN by a column control circuit, the sole output stages CD1, CD2, CD(N−1), and CDN of which are schematically illustrated.

In the considered example, the line control circuits enable making a line active by connecting it to circuit ground GND while the column control circuits enable injecting a luminance current Ilum into diodes 3.

To limit the bulk of the control circuit of display 1, outputs LDk, LD(k+1), LD(k+2), and LD(k+3) of the line control circuit are alternated at the left and right ends of line electrodes 5. For example, for lines Lnk and Ln(k+2), outputs LDk and LD(k+2) are placed to the left of display 1 while outputs LD(k+1) and LD(k+3) of lines Ln(k+1) and Ln(k+3) are placed to the right of display 1. Outputs CD1, CD2, CD(N−1) and CDN of the column control circuit are however all arranged on a same side, for example, at the top, of display 1.

Each diode 3 is associated with a parallel parasitic capacitor 9. The connection of diode 3 to line electrode 5 is associated with a parasitic line resistor 11. Each line electrode 5 is associated with as many parasitic line resistors 11 as display 1 comprises columns Col1, Col2 . . . . Col(N−1), and ColN.

Each line electrode 5 formed against the transparent material of display 1 is associated with a parasitic line capacitor 13.

Figure 2:
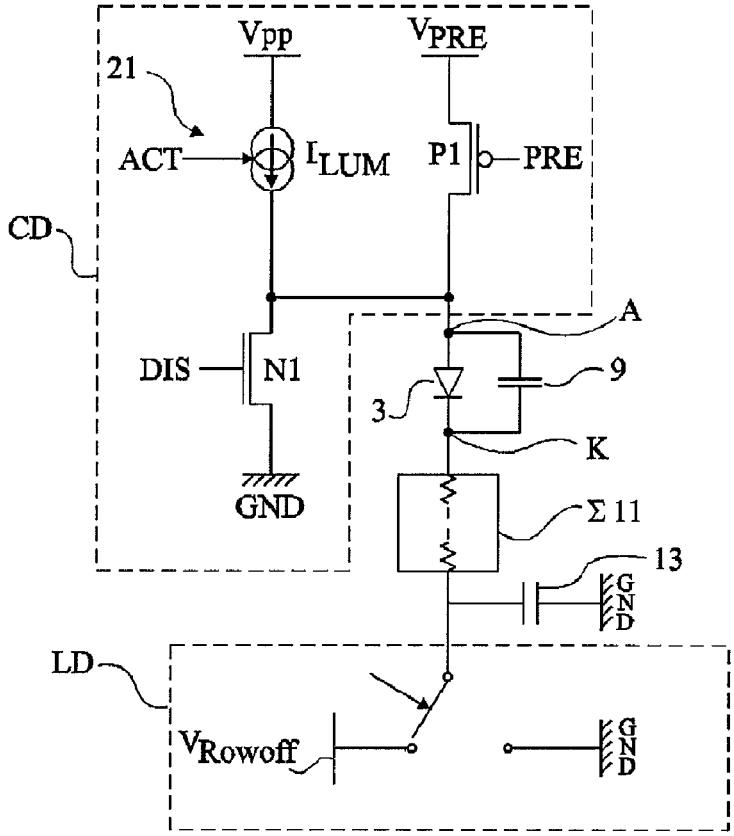
FIG. 2 illustrates, in the form of a circuit diagram, an example of elements of a control circuit associated with the display of FIG. 1.

The operation of a display frame is described hereafter in relation with FIG. 2.

FIG. 2 illustrates in the form of a simplified electric diagram the association of a pixel of FIG. 1 with output stages LD and CD of the line and column control circuits at the intersection of which it is located.

For clarity, the line control circuit is assimilated in the following to its output LD and the column circuit is assimilated to its output CD. The pixel is represented by the parallel association of diode 3 and of its parasitic capacitor 9.

Line control circuit LD enables controllably connecting cathode K of diode 3 either to a standby voltage Vrowoff, or to device ground GND. Standby voltage Vrowoff is positive with respect to ground GND. The pixel is connected to line control circuit LD via a block Σ11 representing all the distributed line resistors 11 introduced by said pixel and all the other pixels arranged between its position on the line electrode and the end of the electrode.

Column control circuit CD is connected to anode A of diode 3. It enables precharging diode 3 (its parasitic capacitor 9) at the beginning of the selection of a line and injecting or not current on anode A when the line is activated. For this purpose, a simple embodiment is the following.

A switch controllable to be turned off and on, for example, a P-channel MOS transistor P1, is connected between a supply rail at precharge voltage Vpre and node A. The gate of transistor P1 can receive a precharge control signal PRE. Anode A is also connected to a current source 21 capable of injecting a luminance current Ilum.

In the case of a color display, each of the colors, generally three colors, that is, red, green, and blue, is associated with a different current source, the luminance current levels being different from one color to another. Similarly, to each color corresponds a different precharge voltage.

Current source 21 is controllable to be activated and deactivated by an activation control signal ACT. The current source is supplied by a high supply rail Vpp of column control circuit CD. A switch controllable to be turned off and on is connected between current source 21 and anode A to enable pulling towards ground GND current Ilum when the pixel should not be activated. For example, an N-channel MOS transistor N is connected between anode A and ground GND. The gate of transistor N1 receives a discharge control signal DIS.

On selection of the line on which it is present, the illumination (or no illumination) control of the pixel of FIG. 2 is implemented as follows.

In a first precharge phase, cathode K, that is, line electrode 5 of FIG. 1, is maintained at standby voltage Vrowoff by line control circuit LD. Current source 21 is deactivated. Transistor N1 is maintained off so that anode A is isolated from ground GND. During this precharge phase, transistor P1 is maintained on so that anode A is connected to precharge power supply Vpre. During this precharge phase, parasitic capacitor 9 of diode 3 charges.

In a second illumination phase, transistor P1 is maintained off, isolating anode A from precharge power supply Vpre. Source 21 is activated, injecting luminance current Ilum. The pixel activation—the emission of light by diode 3—then depends on the state of discharge transistor N1. If the pixel should be activated, transistor N1 is maintained off and luminance current Ilum is conducted by diode 3. If the pixel should be inactive, transistor N1 is turned on and luminance current Ilum is pulled towards ground GND.

According to a variation, to enable a grey level display or a color display with a wide color range, current Ilum is modulated by pulse-controlled switchings of transistor N1 to vary the light emission level of diode 3.

Once the illumination phase is over, the line is de-selected by the deactivation of source 21 and the connection of cathode K (of line electrode 5 of FIG. 1) to stand-by power supply Vrowoff. Transistor N1 may be turned off to isolate the anode from ground GND.

The display control circuit can then repeat for the next line the successive previously-described precharge and illumination phases.

During the precharge phase, anode A (column electrode 7 of FIG. 1) is connected to a rail at a precharge voltage Vpre.

To improve the quality of the displayed image, abovementioned U.S. patent application Ser. No. 11/294,991 provides not using an external source providing a fixed precharge voltage. Said patent application provides modifying column control circuit LD of FIG. 2 to automatically use the operating voltage of the preceding line to perform the precharge of the selected line.

Figure 3:
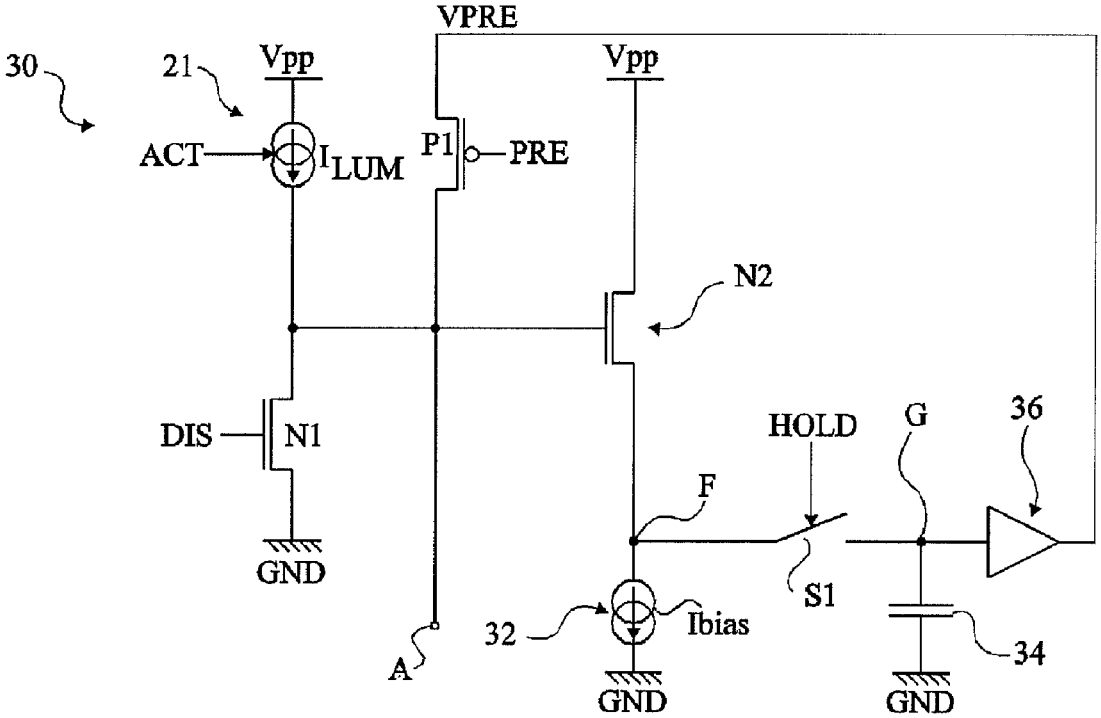
FIG. 3 illustrates, in the form of a circuit diagram, an embodiment of a portion of the control circuit of FIG. 2.

FIG. 3 illustrates a diagram of a column control circuit 30 comprising a device for adapting precharge voltage Vpre according to the operating voltage of the previous line. Circuit 30 is intended to replace circuit LD of FIG. 2.

Like circuit LD, circuit 30 comprises, connected to anode A, source 21, discharge switch N1, and precharge switch P1.

As compared with circuit LD of FIG. 2, circuit 30 additionally comprises an element for measuring the maximum column operating voltage, an element for storing this voltage and an element capable of providing precharge voltage Vpre based on the maximum operating voltage.

The measurement element, for example, is an N-channel MOS transistor N2 having its drain connected to high supply voltage Vpp of column control circuit 30. The gate of transistor N2 is connected to anode A. The source of transistor N2 is connected to a node F.

A source 32 of a biasing current Ibias is connected between node F and ground GND. Node F is further connected to a node G via a switch S1 controllable to be turned off and on by a signal HOLD. A storage element such as a capacitor 34 is connected between node G and ground GND. Terminal G is connected to an amplifier 36 having its output providing precharge voltage Vpre which supplies transistor P1.

It should be noted that node F is common to the N columns Col1, Col2, . . . Col(N−1), and ColN of display 1 of FIG. 1. It is thus common to all the sources of all transistors N2 of all the column control circuits of display 1.

The operation on display of a frame is then similar to that previously described.

However, during a precharge phase, switch S1 is maintained off. Precharge voltage Vpre is then a function of the voltage across capacitor 34.

During the illumination phase, switch S1 is on. As described, during this phase, transistor P1 is off. Then, capacitor 34 stores the voltage level on node F, which is the maximum voltage present on the anodes of the pixels of the selected line.

Then, at the subsequent step of precharge of the next line, amplifier 36 provides a precharge voltage Vpre which is a function of the operating voltage of the previous line stored in capacitor 34.

Due to such an adaptation of precharge voltage Vpre, the image quality is increased.

However, the image still exhibits brightened lines or lines exhibiting a brightness attenuation with respect to the nominal brightness of a given color.

The present inventors have analyzed such brightness anomalies and consider them to be imputable to variations in luminance conditions from one line to the other. Such variations in the luminance conditions especially comprise a modification of the number of activated pixels, to the presence of parasitic line resistors 11 of FIG. 1, of parasitic capacitor 13. In the case of a color screen with grey levels or with a wide color range, such variations also comprise a modification in the intensity of the pixel activation.

The principle of the automated activation of the precharge voltage of a line selected based on the operating voltage of the previous line is explicitly based on the postulate that, from one line to the next, the operating voltage only slightly varies. In practice, this postulate is frequently wrong.

Thus, in an area of the image with a strong contrast, passing from a dark area of the image to a light area translates as an attenuated brightness of the lines of the light area closest to the last dark line. Conversely, passing from a light area to a dark area translates on the first lines comprising the dark area as an overbrightness.

Such anomalies are linked to the corresponding variation of the luminous current on the line electrode. On passing from a dark area to a light area, the number of activated pixels abruptly increases from one line to the other. The luminous line current correspondingly increases. Now, the line current crosses the successive parasitic resistors. The line current increase causes across the parasitic resistors an increased voltage drop which increases more and more as it is drawn closer to the end of the line. This increased voltage drop is reflected across diode 3 and its parasitic capacitor 9. Parasitic capacitor 9 is then no longer sufficiently charged to maintain the emission threshold and part of the current Ilum injected by current source 21 is used to recharge parasitic capacitor 9 to compensate for this increased voltage drop. The light emission by the light-emitting diodes decreases.

Conversely, if the number of activated pixels is decreased in the selected line with respect to the previous line, the line current decreases. The voltage drop across the distributed resistors decreases. The parasitic capacitors which have been charged based on an operating voltage corresponding to a greater voltage drop are then too charged and discharge into the activated diodes, causing an emission increase, whereby the observed overbrightness.

Figure 4:
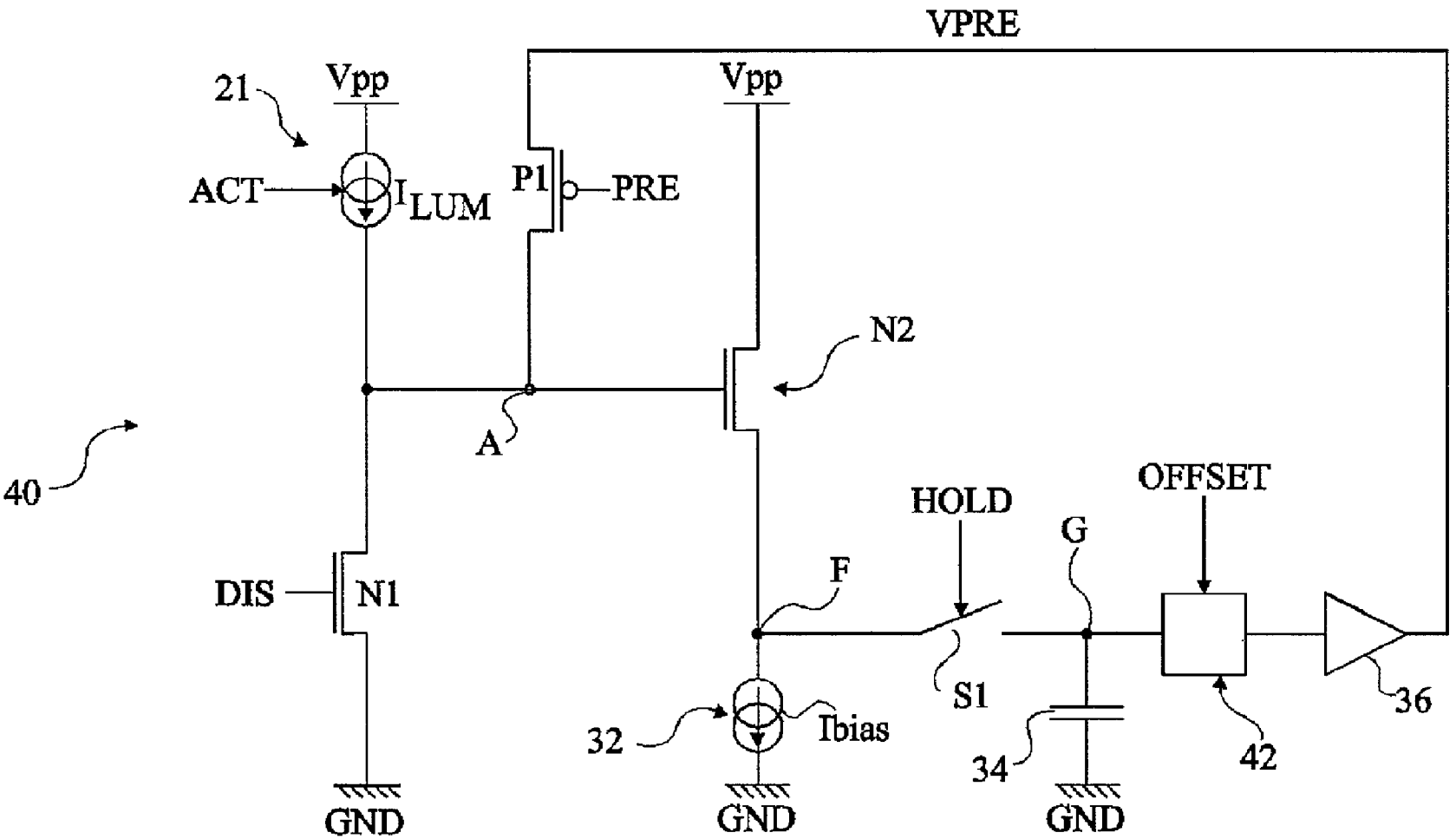
FIG. 4 illustrates, in the form of a circuit diagram, another embodiment of a portion of the control circuit of FIG. 2.

FIG. 4 illustrates in the form of a circuit diagram an embodiment of a column control circuit 40. As compared with control circuit 30 of FIG. 3, circuit 40 further comprises an offset voltage generator 42 placed between capacitor 34 and amplifier 36. Generator 42 receives an offset control signal OFFSET.

According to an embodiment, the operation of the control circuit is the following.

During a precharge phase, the operation is not modified with respect to the operation of circuit 30 of FIG. 3, but for the fact that amplifier 36 now provides precharge voltage Vpre based on the output voltage of generator 42. The output voltage of generator 42 is obtained based on the maximum voltage of the columns stored in capacitor 34 and on offset signal OFFSET.

During an illumination phase, the operation of circuit 40 is similar to that of circuit 30 of FIG. 3.

According to an embodiment, during the illumination phase, switch S1 is only controlled to be turned on when a pixel is lit. Turn-on control signal HOLD of switch S1 is synchronized on control signals DIS of discharge transistors N2 so that switch S1 is only on for a terminal phase of the activation of a pixel.

According to an embodiment, offset control signal OFFSET received by the offset voltage generator before the beginning of the precharge of a selected line depends on the difference in luminance conditions between this line and the previous line.

Figure 5:
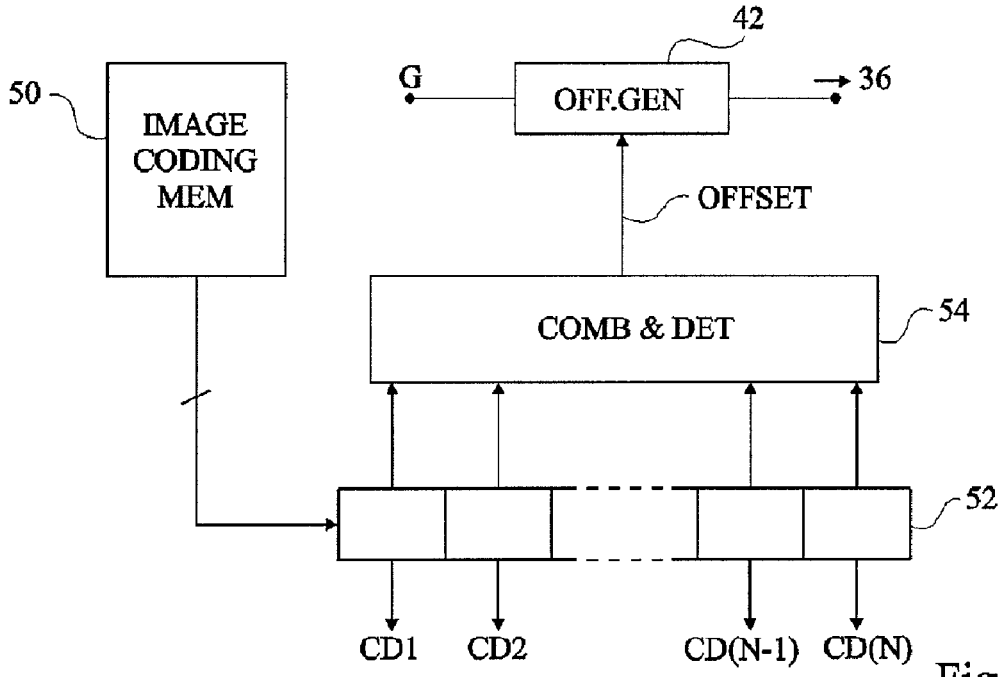
FIG. 5 is a block diagram illustrating an embodiment of an element of the control circuit of FIG. 4.

FIG. 5 illustrates in the form of a block diagram a mode for obtaining an offset control signal OFFSET.

The luminance instructions associated with an image to be displayed are stored in a memory IMAGE CODING MEM 50. These instructions are transmitted to the different control circuits (40, FIG. 4) of the N columns Col1, Col2 . . . . Col(N−1), ColN via a buffer device 52. Buffer device 52 for example comprises a shift register associated with flip-flops. To optimize the display time, the luminance instructions of a line are transferred from memory 50 to the inputs of buffer device 52 during the illumination phase of the previous line. At the time of the transfer of the line instructions, the luminance instructions of a line are still stored in buffer device 52, for example, in a shift register or at the inputs of flip-flops.

According to an embodiment, at the time of their loading into buffer device 52, the luminance instructions of line Ln(k+1), Ln(k+2), or Ln(k+3) are compared with the luminance instructions of the previous line Lnk, Ln(k+1), or Ln(k+2) present in buffer device 52. The results of these comparisons are provided to a combination and determination block COMB & DTE 54. Block 54 combines the comparison results and determines, especially based on the result of the combination, the existence and the sign of a variation in the luminance conditions of line Ln(k+1), Ln(k+2), or Ln(k+3) with respect to the previous line Lnk, Ln(k+1), or Ln(k+2). Block 54 converts the result of the determination into an offset signal OFFSET.

In the subsequent precharge phase of line Ln(k+1), Ln(k+2), or Ln(k+3), signal OFFSET enables offsetting the operating voltage of previous line Lnk, Ln(k+1), or Ln(k+2) based on the difference in luminance conditions between the two successive lines.

Thus, if block 54 determines that the illumination of a line is greater than that of the previous line, it provides generator 42 with an offset control signal OFFSET capable of increasing precharge voltage Vpre with respect to the operating voltage of the previous line. The current variation with respect to the previous line is then compensated.

Conversely, if the line exhibits a lower luminance than the previous line, block 54 determines a negative variation and provides an offset control signal OFFSET capable of lowering precharge voltage Vpre with respect to the operating voltage of the next line.

According to an embodiment, in the case of a monochrome (black and white) or color display with a narrow color range, the luminance instructions transmitted from memory 50 to buffer device 52 are binary instructions for switching discharge transistor N1. The combination performed by block 54 then is a summing up of the comparison results.

According to another embodiment, in the case of a display with grey levels or of a display with a wide color range, the luminance instructions transmitted to the column control circuits CD1, CD2 . . . CD(N−1), and CDN are coded modulation instructions. Such coded instructions are processed by a pilot circuit of each column control circuit, which samples from a table the corresponding discharge control signal DIS to be applied to the gate of discharge transistor N1 (FIG. 4). The comparison is then performed to determine whether the coded instructions are identical. If not, the different coded instructions are provided to combination block 54. Block 54 then determines the variation of occurrence of each coded instruction. Block 54 samples from the table the values of signal DIS associated with the coded instructions and determines the luminance variation.

According to an embodiment, block 54 performs a combination of the comparison results across then entire line.

As a summary, offset control signal OFFSET delivered to generator 42 is determined by block 54 based on at least one of the comparisons between the selected line and the previous line:

of the number of activated pixels; and/or of the activation level of the activated pixels.

Further, signal OFFSET is determined during the illumination period of the previous line and is provided to generator 42 at latest at the beginning of the line selection.

Figure 6:
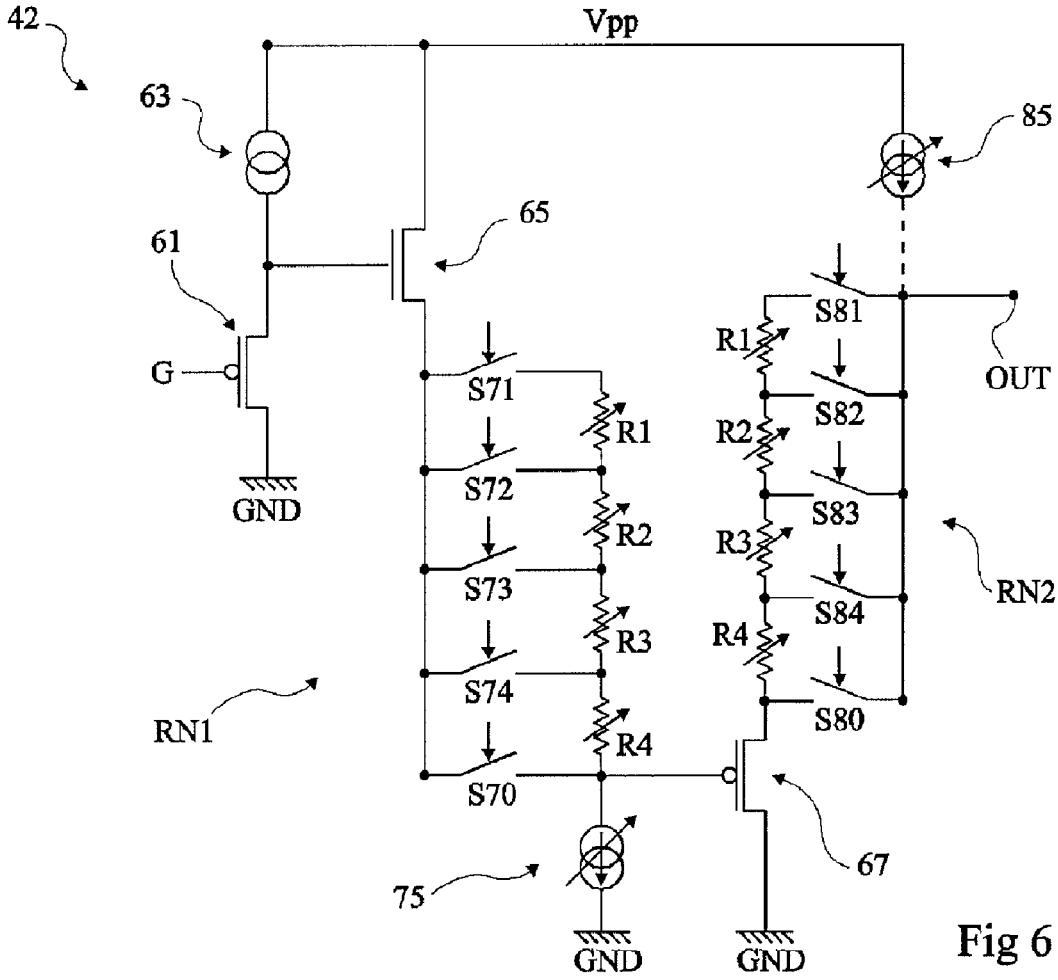
FIG. 6 illustrates, in the form of a circuit diagram, an embodiment of another element of the control circuit of FIG. 4.

FIG. 6 illustrates in the form of an equivalent electric diagram an embodiment of offset voltage generator 42 of FIGS. 4 and 5.

Generator 42 receives as an input G the voltage across capacitor 34 (FIG. 4). This voltage is applied to the gate of a P-channel MOS transistor 61 having its source connected to a bias current source 63 and its drain connected to circuit ground GND. Current source 63 is biased by high power supply Vpp of the column control circuit.

The source of transistor 61 is also connected to the gate of an N-channel MOS transistor 65 having its drain connected to high power supply Vpp. The source of transistor 65 is connectable to the gate of a P-channel MOS transistor 67, either directly by a switch S70 controllable to be turned on and off, or via a first resistor network RN1. Network RN1 for example comprises four resistors R1, R2, R3, and R4, each associated with a respective switch controllable to be turned off and on S71, S72, S73, and S74 and a bias current source 75 connected between the gate of transistor 67 and ground GND. The drain of transistor 67 is connected to ground GND. The source of transistor 67 is connectable to output OUT of generator 42, either directly by a switch S80 controllable to be turned on and off, or via a second resistor network RN2. Network RN2 is similar to network RN1 and, for example, comprises four resistors R1, R2, R3, and R4 each associated with a respective switch controllable to be turned off and on S81, S82, S83, and S84 and a bias current source 85 connected between high power supply Vpp and output OUT.

The activation of networks RN1 and RN2 is asymmetrical and depends on signal OFFSET. For example, if the variation of precharge voltage Vpre should be negative with respect to the voltage applied to node G, first network RN1 is activated and switch S80 enables short-circuiting second network RN2. Complementarily, if the precharge voltage variation should be positive with respect to the voltage applied at node G, first network RN1 is short-circuited by switch S70 and second network RN2 is activated. The selection of the activated resistors depends on the value of the offset to be performed. This value determined by block 54 of FIG. 5 is contained in signal OFFSET which controls the turning off and on of the different switches S71, S72, S73, and S74 and/or S81, S82, S83, and S84.

Current sources 75 and 85 have identical characteristics. They are activated at the same time as generator 42 to enable biasing of follower transistors 65 and 67.

According to an embodiment, the current value provided by sources 75 and 85, and thus the applied offset, depends on the elementary luminous current running through a column and also on the line resistivity. In the case of a color display, the elementary luminous current is the sum of the elementary luminous currents injected into each of the column electrodes of different colors associated with a column.

Of course, in the case of a grey level or color display, the determination of the average line current value should take into account the level or the color of the activated pixel.

According to an embodiment, the values of resistances R1, R2, R3, and R4 are irreversibly set (one-time programmable network) at the end of the display manufacturing at the time of display operation tests. During such tests, the average value of the parasitic line resistors and their average difference between two consecutive lines are assessed.

According to another embodiment, the values of resistors R1, R2, R3, and R4 are programmable. They are then reassessed to take into account drifts occurring either during a prolonged or intense use, for example, due to thermal phenomena, or on each display restarting to take into account drifts linked to an aging of the components.

According to another embodiment, the values of the resistances of networks RN1 and RN2 are not identical two by two, but are likely to differ from one network to another. This may be the case to optimize the offset network capable of compensating for a brightness decrease which may translates as an information loss for the user while the offset network capable of attenuating a brightness increase may be less accurate.

According to another embodiment, the resistance values of networks RN1 and RN2 are selected to take into account the line resistivity. Then, current sources 75 and 85 no longer take this parameter into account, but rather the elementary luminous current.

Indeed, the voltage drop in a line is as a first approximation a function of the product of the line resistance by the elementary current and by the number of pixels. At the level of generator 42, it may be modeled by a product of the network resistances and of the current delivered by sources 75 and 85. Any variation in the line resistivity can thus be taken into account by modifying the values either of the resistances of networks RN1 and RN2 or of the currents delivered by sources 75 and 85. Such a taking into account may be performed once and for all during operation tests at the end of the display manufacturing, for example by means of networks of one-time programmable (OTP) resistors associated with each of networks RN1 and RN2. Test protocols may also be periodically performed to modify the operating point of generator 42, for example, by using a register of current multiplying or dividing factors associated with sources 75 and 85 to modulate the copying of the elementary currents.

In the previous embodiments, the precharge has been considered to be performed by a voltage precharge and an adaptation of the voltage value applied to the luminance condition variations on passing from one line to another has been performed. However, if the precharge is performed with a current, it is also advantageous to adapt the injected current according to such variations. It will be within the abilities of those skilled in the art to adapt the embodiments previously described in the case of a voltage precharge to a current precharge.

Generally, the previously-described embodiments are likely to have various alterations and modifications will occur to those skilled in the art. In particular, only those elements and operation phases necessary to the understanding of the examples have been shown and described.

Thus, the way in which the control signals of the control circuit of a display are generated has not been detailed.

Further, for clarity, the described phases have been simplified to limit the description to the sole elements necessary to the understanding. It will be within the abilities of those skilled in the art to adapt the control to known methods. Thus, the precharge step may start with a discharge step.

Moreover, the detailed structure of the different elements has not been specified. It will be within the abilities of those skilled in the art to select them according to the aimed application. Thus, it will be within the abilities of those skilled in the art to form the luminance current sources (21, FIG. 4). For example, the luminance current sources will be cascode assemblies of two P-channel MOS transistors, all the luminance sources of a same color sharing a same bias circuit.

Similarly, the line control circuit structure has not been described.

Further, it will be within the abilities of those skilled in the art to use an adaptation of the precharge level according to a variation in luminance conditions between two consecutive lines, whatever the precharge voltage generation mode. Thus, the structure of the circuit for adapting the precharge voltage of a line according to the operating voltage of the previous line may be different from the sampling system formed of transistor N2, bias source 32, switch S1, capacitor 34, and amplifier 36 described in relation with FIGS. 3 and 4.

Moreover, it will be within the abilities of those skilled in the art to adapt the algorithmic calculation performed to generate signal OFFSET at the level of buffer device 52 as well as at the level of block 54 according to the display type, that is, to the coding of the image to be displayed. It will also be within the abilities of those skilled in the art to adapt the calculation of signal OFFSET according to the switching information necessary for the operation of generator 42.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A device for controlling an electroluminescent matrix display by successive selection of its lines, comprising a column control circuit comprising a precharge circuit configured to place, at a beginning of the selection of a line, the display columns at a precharge voltage based on the operating voltage of the previous line, wherein the column control circuit also comprises an offset voltage generator configured to modify the precharge voltage according to a difference between luminance instructions of a previous line and those of the selected line, the device further comprising a comparison circuit configured to compare the luminance instructions for each pixel of the selected line with the luminance instructions for each pixel of the previous line and to provide a result for each pixel of the selected line, and a combination circuit configured to combine the results for each pixel and to provide an offset value to the offset voltage generator.

2. The device of claim 1, wherein each column control circuit comprises means for detecting the maximum operation voltage of the column, having an output terminal capable of being controllably connected to a storage element common to all columns and an element capable of delivering, at least during a phase of precharge of the selected line, a precharge reference value based on the data stored in the storage element.

3. The device of claim 2, wherein the offset voltage generator is interposed between the storage element and the element delivering the precharge reference value.

4. The device of claim 3, wherein the offset voltage generator comprises means capable of modeling the resistivity of the precharged line.

5. The device of claim 1, wherein the precharge is performed with a voltage.

6. The device of claim 1, wherein the luminance instructions of the previous line and the luminance instructions of the selected line are contained in an image memory.

7. A method of line-by-line control of a matrix display comprising light-emitting diodes arranged at the intersection of lines and columns, comprising, at the beginning of the selection a line, a step of line precharge based on the operating voltage of a previous line, wherein the step of precharge of the selected line is preceded by determining a difference between the luminance conditions of each pixel of the selected line and the luminance conditions of each pixel of the previous line and providing a result for each pixel of the selected line, combining the results to provide an ofset value, and modifying the precharge according to the offset value.

8. The method of claim 7, wherein determining the difference in luminance conditions between the selected line and the previous line comprises comparing the number of diodes activated on each of the selected and previous lines.

9. The method of claim 7, wherein determining the difference in luminance conditions between the selected line and the previous line comprises comparing the excitation times of the diodes activated on each of the selected and previous lines.

10. The method of claim 7, wherein determining the difference in luminance conditions between the selected line and the previous line is totally completed during the luminance period of the previous line.

11. A circuit for controlling a matrix display including light-emitting diodes at intersections of lines and columns of the display, comprising:

a detection circuit configured to determine a difference in luminance conditions between a selected line of the display and a previous line of the display, wherein the detection circuit includes a comparison circuit configured to compare luminance instructions for each pixel of the selected line with luminance instructions for each pixel of the previous line and to provide a result for each pixel of the selected line, and a combination circuit configured to combine the results and provide an offset value; and a column control circuit configured to supply a precharge quantity to columns of the selected line, the column control circuit including an offset circuit configured to modify the precharge quantity of the selected line of the display based at least in part on the offset value.

12. Apparatus as defined in claim 11, wherein the detection circuit is configured to determine the difference between a number of activated pixels in the selected line and a number of activated pixels in the previous line.

13. Apparatus as defined in claim 11, wherein the detection circuit is configured to determine the difference between an intensity of pixel activation in the selected line and an intensity of pixel activation in the previous line.

14. Apparatus as defined in claim 11, wherein the column control circuit is configured to supply the precharge quantity to columns of the selected line based in part on the precharge quantity of the previous line.

15. Apparatus as defined in claim 11, wherein the offset circuit includes programmable resistor networks configured to enable positive or negative modifications of the precharge quantity.

16. Apparatus as defined in claim 11, wherein the offset circuit is configured to increase the precharge quantity if the detection circuit determines that the luminance of the selected line is greater than the luminance of the previous line.

17. Apparatus as defined in claim 11, wherein the offset circuit is configured to decrease the precharge quantity if the detection circuit determines that the luminance of the selected line is lower than the luminance of the previous line.

18. A method for controlling a matrix display including light-emitting diodes at intersections of lines and columns of the display, comprising:

determining, by a detection circuit, a difference in luminance conditions between a selected line of the display and a previous line of the display, wherein determining the difference in luminance conditions includes comparing luminance instructions for each pixel of the selected line with luminance instructions for each pixel of the previous line, and combining the results of each comparison to provide an offset value; and supplying, by a column control circuit, a precharge quantity to columns of the selected line, including modifying the precharge quantity of the selected line of the display based at least in part on the offset value.

19. A method as defined in claim 18, including modifying the precharge quantity based on the difference between the number of activated pixels in the selected line and the number of activated pixels in the previous line.

20. A method as defined in claim 18, including modifying the precharge quantity based on the difference between the intensity of pixel activation in the selected line and the intensity of pixel activation in the previous line.

21. A method as defined in claim 18, further comprising supplying the precharge quantity based in part on the precharge quantity of the previous line.

22. A method as defined in claim 18, wherein modifying the precharge quantity includes increasing the precharge quantity if the luminance of the selected line is greater than the luminance of the previous line.

23. A method as defined in claim 18, wherein modifying the precharge quantity includes decreasing the precharge quantity if the luminance of the selected line is lower than the luminance of the previous line.

* * * * *

UNITED STATES PATENT AND TRADEMARK OFFICE

CERTIFICATE OF CORRECTION

PATENT NO. : 8,138,998 B2
APPLICATION NO. : 12/101729
DATED : March 20, 2012
INVENTOR(S) : Céline Mas et al.

It is certified that error appears in the above-identified patent and that said Letters Patent is hereby corrected as shown below:

Col. 3, line 61 should read:
nance current Ilum into diodes 3.

Col. 4, line 41 should read:
injecting a luminance current Ilum.
Col. 4, line 52 should read
pulling towards ground GND current Ilum when the pixel Col. 5, line 3 should read:
Source 21 is activated, injecting luminance current Ilum. The
Col. 5, line 7 should read:
nance current Ilum is conducted by diode 3. If the pixel should
Col. 5, line 9 should read:
Ilum is pulled towards ground GND.
Col. 5, line 11 should read:
color display with a wide color range, current Ilum is modu- Col. 6, line 41 should read:
the emission threshold and part of the current Ilum injected by Col. 11, line 21 should read:
combining the results to provide an offset value, and modify Signed and Sealed this
First Day of May, 2012

David J. Kappos

David J. Kappos
*Director of the United States Patent and Trademark Office*